US010741062B2

(12) United States Patent
Macfarlane

(10) Patent No.: US 10,741,062 B2
(45) **Date of Patent: *Aug. 11, 2020**

(54) DETERMINATION OF A FREE-FLOW SPEED FOR A LINK SEGMENT

(71) Applicant: HERE Global B.V., Eindhoven (NL)

(72) Inventor: Jane Macfarlane, Oakland, CA (US)

(73) Assignee: HERE Global B.V., Eindhoven (NL)

( * ) Notice: Subject to any disclaimer, the term of this patent is extended or adjusted under 35 U.S.C. 154(b) by 258 days.

This patent is subject to a terminal disclaimer.

(21) Appl. No.: 15/670,143

(22) Filed: Aug. 7, 2017

(65) Prior Publication Data

US 2017/0337811 A1 Nov. 23, 2017

Related U.S. Application Data

(63) Continuation of application No. 14/751,682, filed on Jun. 26, 2015, now Pat. No. 9,761,133.

(51) Int. Cl.
*G08G 1/01* (2006.01)

(52) U.S. Cl.
CPC ..... *G08G 1/0129* (2013.01); *G08G 1/0112* (2013.01); *G08G 1/0133* (2013.01); *G08G 1/0141* (2013.01)

(58) Field of Classification Search
CPC ..... G08G 1/0112; G08G 1/0133; G08G 1/20; G08G 1/0104; G08G 1/0129; G08G 1/052; G08G 1/096716; G08G 1/096844; G08G 1/0108; G08G 1/0116; G08G 1/012; G08G 1/0137; G08G 1/0141; G08G 1/0145; G08G 1/096758; G08G 1/096775;

(Continued)

(56) References Cited

U.S. PATENT DOCUMENTS 7,908,076 B2 3/2011 Downs et al.
8,290,695 B2 10/2012 Hiestermann et al.

(Continued)

OTHER PUBLICATIONS

Awasthi et al., Using Hybrid Clustering to Approximate Fastest Paths on Urban Networks, 2006.

(Continued)

*Primary Examiner* — Tuan C To
*Assistant Examiner* — Paul A Castro
(74) *Attorney, Agent, or Firm* — Lempia Summerfield Katz LLC

(57) ABSTRACT

A method comprising determining speed-time cluster application histogram data set for a link segment that comprises a plurality of speed-time cluster application histogram data elements, each speed-time cluster application histogram data element identifying a speed-time cluster and an applicable duration of the speed-time cluster for the link segment throughout a histogram duration, for each speed-time cluster application histogram data element, determining a free-flow speed that is representative of a non-congestion speed indicated by the speed-time cluster, determining a historically normalized free-flow speed for the link segment that is a weighted average of the free-flow speed determined for each speed-time cluster application histogram data element weighted by the applicable duration of the speed-time cluster application histogram data element, and identifying a transit speed of the link segment as being the historically normalized free-flow speed is disclosed.

20 Claims, 12 Drawing Sheets

(58) Field of Classification Search
CPC ..... G08G 1/096811; G08G 1/096827; G08G 1/096888; G08G 1/123
See application file for complete search history.

(56) References Cited

U.S. PATENT DOCUMENTS

| | | | | |
|---|---|---|---|---|
| 8,396,663 | B2 | 3/2013 | Tennent et al. | |
| 8,478,499 | B2 | 7/2013 | Rupp et al. | |
| 8,653,986 | B2 | 2/2014 | Tamir et al. | |
| 2009/0043486 | A1 | 2/2009 | Yang et al. | |
| 2010/0076671 | A1 | 3/2010 | Pryakhin et al. | |
| 2010/0250127 | A1 | 9/2010 | Hilbrandie et al. | |
| 2011/0153189 | A1 | 6/2011 | Chiang et al. | |
| 2013/0103290 | A1* | 4/2013 | Hardin | H04W 4/029 701/117 |
| 2014/0277835 | A1 | 9/2014 | Filev et al. | |
| 2015/0160025 | A1* | 6/2015 | Konig | G01C 21/3415 701/410 |
| 2015/0228188 | A1 | 8/2015 | Macfarlane et al. | |
| 2016/0027299 | A1 | 1/2016 | Raamot | |

OTHER PUBLICATIONS

Herreraa et al., Incorporation of Lagrangain Measurements in Freeway Traffic State Estimation, Oct. 26, 2009, www.elsevier.com/local/trb.

Rudra Pratab Deb Nath et al., A Naive Clustering Approach in Travel Time Prediction, 2011, vol. 2, Issue 2, International Journal of Data Engineering.

Shekhar et al., Spatial Big-Data Challenges Intersecting Mobility and Cloud Computing, 2012, A Position Paper for 2012 NSF Workshop on Social Networks and Mobility in the Cloud.

* cited by examiner

DETERMINATION OF A FREE-FLOW SPEED FOR A LINK SEGMENT

This application is a continuation under 37 C.F.R. § 1.53(b) and 35 U.S.C. § 120 of U.S. patent application Ser. No. 14/751,682 filed Jun. 26, 2015 which is incorporated by reference in its entirety.

TECHNICAL FIELD

The present application relates generally to determination of a free-flow speed for a link segment.

BACKGROUND

As more people travel on various thoroughfares, traffic data is increasingly collected. Many electronic apparatuses, services, and/or the like may use such traffic data for various functions. As such, it may be desirable to configure an electronic apparatus such that the electronic apparatus facilitates gathering and/or analyzing such traffic data.

SUMMARY

Various aspects of example embodiments are set out in the summary, the drawings, the detailed description, and the claims.

One or more example embodiments may provide an apparatus, a computer readable medium, a non-transitory computer readable medium, a computer program product, and/or a method for determining speed-time cluster application histogram data set for a link segment that comprises a plurality of speed-time cluster application histogram data elements, each speed-time cluster application histogram data element identifying a speed-time cluster and an applicable duration of the speed-time cluster for the link segment throughout a histogram duration, for each speed-time cluster application histogram data element, determining a free-flow speed that is representative of a non-congestion speed indicated by the speed-time cluster, determining a historically normalized free-flow speed for the link segment that is a weighted average of the free-flow speed determined for each speed-time cluster application histogram data element weighted by the applicable duration of the speed-time cluster application histogram data element, and identifying a transit speed of the link segment as being the historically normalized free-flow speed.

One or more example embodiments may provide an apparatus, a computer readable medium, a computer program product, and/or a non-transitory computer readable medium having means for determining speed-time cluster application histogram data set for a link segment that comprises a plurality of speed-time cluster application histogram data elements, each speed-time cluster application histogram data element identifying a speed-time cluster and an applicable duration of the speed-time cluster for the link segment throughout a histogram duration, for each speed-time cluster application histogram data element, means for determining a free-flow speed that is representative of a non-congestion speed indicated by the speed-time cluster, means for determining a historically normalized free-flow speed for the link segment that is a weighted average of the free-flow speed determined for each speed-time cluster application histogram data element weighted by the applicable duration of the speed-time cluster application histogram data element, and means for identifying a transit speed of the link segment as being the historically normalized free-flow speed.

In at least one example embodiment, a link segment is at least a portion of at least one of a route, a lane, a road, a highway, a street, a trail, or a thoroughfare.

In at least one example embodiment, a speed-time cluster is the result of clustering a plurality of similar link segment profiles.

In at least one example embodiment, a link segment profile is a speed-vs-time curve associated with a particular link segment.

In at least one example embodiment, an applicable duration of the speed-time cluster for the link segment throughout the histogram duration is the period of time for which the speed-time cluster application histogram data set is recorded.

In at least one example embodiment, a non-congestion speed is a speed above a threshold speed.

In at least one example embodiment, the determination of the speed-time cluster application histogram data set comprises receipt of probe data indicative of speed of travel along the link segment, identification of an applicable speed-time cluster associated with the link segment that is applicable to the probe data, determination of an applicable duration throughout the histogram duration in which the applicable speed-time cluster is applicable to the probe data, and determination of a speed-time cluster application histogram data element of the speed-time cluster application histogram data set that indicates the applicable speed-time cluster and the applicable duration.

In at least one example embodiment, probe data is a plurality of data points within a set of real time traffic data.

In at least one example embodiment, determination of the free-flow speed comprises identification of portions of the speed-time cluster that are indicative of non-congestion, and determination of the free-flow speed based on a speed indicated by the identified portions of the speed-time cluster that are indicative of non-congestion.

In at least one example embodiment, the determination of the free-flow speed based on the speed indicated by the identified portions of the speed-time cluster omits portions of the speed-time cluster that are indicative of congestion.

In at least one example embodiment, the determination of the free-flow speed based on the speed indicated by the identified portions of the speed-time cluster comprises determination of the free-flow speed based on a maximum speed indicated by the identified portions of the speed-time cluster that are indicative of non-congestion.

In at least one example embodiment, the determination of the free-flow speed based on the speed indicated by the identified portions of the speed-time cluster comprises determination of the free-flow speed based on a percentage of a maximum speed indicated by the identified portions of the speed-time cluster that are indicative of non-congestion.

In at least one example embodiment, the percentage is between 80 percent and 90 percent.

One or more example embodiments further perform determination that the link segment is geospatially associated with a set of link segments, and identification of a transit speed of the set of link segments as being the historically normalized free-flow speed.

In at least one example embodiment, identifying a transit speed of the link segment comprises at least one of utilization of the transit speed in an estimated time of arrival calculation, generation of a long term traffic flow report that characterizes the link segment.

BRIEF DESCRIPTION OF THE DRAWINGS

For a more complete understanding of one or more example embodiments, reference is now made to the following descriptions taken in connection with the accompanying drawings in which.

DETAILED DESCRIPTION OF THE DRAWINGS

Figure 1:
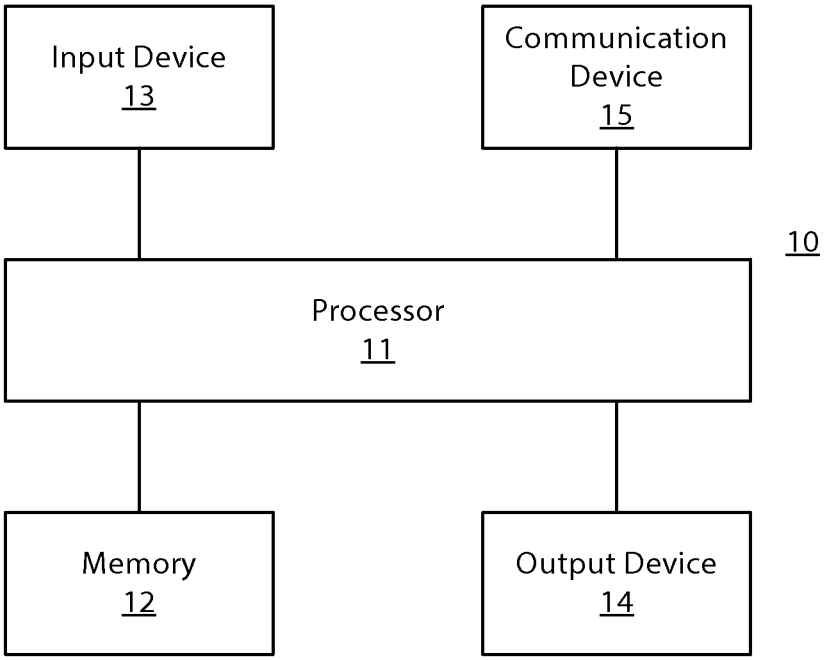
FIG. 1 is a block diagram showing an apparatus according to at least one example embodiment.

Various example embodiments and some of their potential advantages are understood by referring to FIGS. 1 through 10 of the drawings.

Some example embodiments will now further be described hereinafter with reference to the accompanying drawings, in which some, but not all, example embodiments are shown. One or more example embodiments may be embodied in many different forms and the claims should not be construed as being strictly limited to the example embodiments set forth herein; rather, these example embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with one or more example embodiments. Thus, use of any such terms should not be taken to limit the spirit and scope of example embodiments.

Additionally, as used herein, the term 'circuitry' refers to (a) hardware-only circuit implementations (e.g., implementations in analog circuitry, digital circuitry and/or any combination thereof); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that utilize software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit, an applications processor integrated circuit, a cellular network apparatus, other network apparatus, and/or other computing apparatus.

As defined herein, a "non-transitory computer readable medium," which refers to a physical medium (e.g., volatile or non-volatile memory device), can be differentiated from a "transitory computer-readable medium," which refers to an electromagnetic signal. In at least one example embodiment, a non-transitory computer readable medium is a tangible non-transitory computer readable medium.

FIG. 1 is a block diagram showing an apparatus, such as an electronic apparatus 10, according to at least one example embodiment. It should be understood, however, that an electronic apparatus as illustrated and hereinafter described is merely illustrative of an electronic apparatus that could benefit from one or more example embodiments and, therefore, should not be taken to limit the scope of the claims. While electronic apparatus 10 is illustrated and will be hereinafter described for purposes of example, other types of electronic apparatuses may readily employ one or more example embodiments. Electronic apparatus 10 may be a personal digital assistant (PDAs), a pager, a mobile computer, a desktop computer, a television, a gaming apparatus, a laptop computer, a tablet computer, a media player, a camera, a video recorder, a mobile phone, a global positioning system (GPS) apparatus, an automobile, a kiosk, an electronic table, a cloud computing system, and/or any other types of electronic systems. Moreover, the apparatus of at least one example embodiment need not be the entire electronic apparatus, but may be a component or group of components of the electronic apparatus in other example embodiments. For example, the apparatus may be an integrated circuit, a set of integrated circuits, and/or the like.

Furthermore, apparatuses may readily employ one or more example embodiments regardless of any intent to provide mobility. In this regard, even though some example embodiments may be described in conjunction with mobile applications, it should be understood that such example embodiments may be utilized in conjunction with a variety of other applications, both in the mobile communications industries and outside of the mobile communications industries. For example, the apparatus may be, at least part of, a non-carryable apparatus, such as a large screen television, an electronic table, a kiosk, an automobile, and/or the like.

In at least one example embodiment, electronic apparatus 10 comprises at least one processor, such as processor 11 and at least one memory, such as memory 12. Processor 11 may be any type of processor, controller, embedded controller, processor core, and/or the like. In at least one example embodiment, processor 11 utilizes computer program code to cause an apparatus to perform one or more actions. Memory 12 may comprise volatile memory, such as volatile Random Access Memory (RAM) including a cache area for the temporary storage of data and/or other memory, for example, non-volatile memory, which may be embedded and/or may be removable. The non-volatile memory may comprise an EEPROM, flash memory and/or the like. Memory 12 may store any of a number of pieces of information, and data. The information and data may be used by the electronic apparatus 10 to implement one or more functions of the electronic apparatus 10, such as the functions described herein. In at least one example embodiment, memory 12 includes computer program code such that the memory and the computer program code are configured to, working with the processor, cause the apparatus to perform one or more actions described herein.

The electronic apparatus 10 may further comprise a communication device 15. In at least one example embodiment, communication device 15 comprises an antenna, (or multiple antennae), a wired connector, and/or the like in operable communication with a transmitter and/or a receiver. In at least one example embodiment, processor 11 provides signals to a transmitter and/or receives signals from a receiver. The signals may comprise signaling information in accordance with a communications interface standard, user speech, received data, user generated data, and/or the like. Communication device 15 may operate with one or more air interface standards, communication protocols, modulation types, and access types (e.g., one or more standards in the Institute of Electrical and Electronics Engineers (IEEE) 802 family of wired and wireless standards). By way of illustration, the electronic communication device 15 may operate in accordance with second-generation (2G) wireless communication protocols IS-136 (time division multiple access (TDMA)), Global System for Mobile communications (GSM), and IS-95 (code division multiple access (CDMA)), with third-generation (3G) wireless communication protocols, such as Universal Mobile Telecommunications System (UMTS), CDMA2000, wideband CDMA (WCDMA) and time division-synchronous CDMA (TD-SCDMA), and/or with fourth-generation (4G) wireless communication protocols, wireless networking protocols, such as 802.11, short-range wireless protocols, such as Bluetooth, and/or the like. Communication device 15 may operate in accordance with wireline protocols, such as Ethernet, digital subscriber line (DSL), asynchronous transfer mode (ATM), and/or the like.

Processor 11 may comprise means, such as circuitry, for implementing audio, video, communication, navigation, logic functions, and/or the like, as well as for implementing one or more example embodiments including, for example, one or more of the functions described herein. For example, processor 11 may comprise means, such as a digital signal processor device, a microprocessor device, an analog to digital converter, a digital to analog converter, processing circuitry and other circuits, for performing various functions including, for example, one or more of the functions described herein. The apparatus may perform control and signal processing functions of the electronic apparatus 10 among these devices according to their respective capabilities. The processor 11 thus may comprise the functionality to encode and interleave message and data prior to modulation and transmission. The processor 1 may additionally comprise an internal voice coder, and may comprise an internal data modem. Further, the processor 11 may comprise functionality to operate one or more software programs, which may be stored in memory and which may, among other things, cause the processor 11 to implement at least one embodiment including, for example, one or more of the functions described herein. For example, the processor 11 may operate a connectivity program, such as a conventional internet browser. The connectivity program may allow the electronic apparatus 10 to transmit and receive internet content, such as location-based content and/or other web page content, according to a Transmission Control Protocol (TCP), Internet Protocol (IP), User Datagram Protocol (UDP), Internet Message Access Protocol (IMAP), Post Office Protocol (POP), Simple Mail Transfer Protocol (SMTP), Wireless Application Protocol (WAP), Hypertext Transfer Protocol (HTTP), and/or the like, for example.

The electronic apparatus 10 may comprise a user interface for providing output and/or receiving input. The electronic apparatus 10 may comprise an output device 14. Output device 14 may comprise an audio output device, such as a ringer, an earphone, a speaker, and/or the like. Output device 14 may comprise a tactile output device, such as a vibration transducer, an electronically deformable surface, an electronically deformable structure, and/or the like. Output device 14 may comprise a visual output device, such as a display, a light, and/or the like. In at least one example embodiment, the apparatus causes display of information, the causation of display may comprise displaying the information on a display comprised by the apparatus, sending the information to a separate apparatus, and/or the like. For example, the apparatus may send the information to a separate display, to a computer, to a laptop, to a mobile apparatus, and/or the like. For example, the apparatus may be a server that causes display of the information by way of sending the information to a client apparatus that displays the information. In this manner, causation of display of the information may comprise sending one or more messages to the separate apparatus that comprise the information, streaming the information to the separate apparatus, and/or the like. The electronic apparatus may comprise an input device 13. Input device 13 may comprise a light sensor, a proximity sensor, a microphone, a touch sensor, a force sensor, a button, a keypad, a motion sensor, a magnetic field sensor, a camera, and/or the like. A touch sensor and a display may be characterized as a touch display. In an embodiment comprising a touch display, the touch display may be configured to receive input from a single point of contact, multiple points of contact, and/or the like. In such an embodiment, the touch display and/or the processor may determine input based, at least in part, on position, motion, speed, contact area, and/or the like. In at least one example embodiment, the apparatus receives an indication of an input. The apparatus may receive the indication from a sensor, a driver, a separate apparatus, and/or the like. The information indicative of the input may comprise information that conveys information indicative of the input, indicative of an aspect of the input indicative of occurrence of the input, and/or the like.

The electronic apparatus 10 may include any of a variety of touch displays including those that are configured to enable touch recognition by any of resistive, capacitive, infrared, strain gauge, surface wave, optical imaging, dispersive signal technology, acoustic pulse recognition, or other techniques, and to then provide signals indicative of the location and other parameters associated with the touch. Additionally, the touch display may be configured to receive an indication of an input in the form of a touch event which may be defined as an actual physical contact between a selection object (e.g., a finger, stylus, pen, pencil, or other pointing device) and the touch display. Alternatively, a touch event may be defined as bringing the selection object in proximity to the touch display, hovering over a displayed object or approaching an object within a predefined distance, even though physical contact is not made with the touch display. As such, a touch input may comprise any input that is detected by a touch display including touch events that involve actual physical contact and touch events that do not involve physical contact but that are otherwise detected by the touch display, such as a result of the proximity of the selection object to the touch display. A touch display may be capable of receiving information associated with force applied to the touch screen in relation to the touch input. For example, the touch screen may differentiate between a heavy press touch input and a light press touch input. In at least one example embodiment, a display may display two-dimensional information, three-dimensional information and/or the like.

In example embodiments including a keypad, the keypad may comprise numeric (for example, 0-9) keys, symbol keys (for example, #, *), alphabetic keys, and/or the like for operating the electronic apparatus 10. For example, the keypad may comprise a conventional QWERTY keypad arrangement. The keypad may also comprise various soft keys with associated functions. In addition, or alternatively, the electronic apparatus 10 may comprise an interface device such as a joystick or other user input interface.

Input device 13 may comprise a media capturing element. The media capturing element may be any means for capturing an image, video, and/or audio for storage, display, or transmission. For example, in at least one example embodiment in which the media capturing element is a camera module, the camera module may comprise a digital camera which may form a digital image file from a captured image. As such, the camera module may comprise hardware, such as a lens or other optical component(s), and/or software for creating a digital image file from a captured image. Alternatively, the camera module may comprise only the hardware for viewing an image, while a memory device of the electronic apparatus 10 stores instructions for execution by the processor 11 in the form of software for creating a digital image file from a captured image. In at least one example embodiment, the camera module may further comprise a processing element that is separate from processor 11 for processing data, such as image data. The camera module may provide data, such as image data, in one or more of various formats. In at least one example embodiment, the camera module comprises an encoder, a decoder, and/or the like for compressing and/or decompressing image data. The encoder and/or decoder may encode and/or decode according to a standard format, for example, a Joint Photographic Experts Group (JPEG) standard format.

Figure 2:
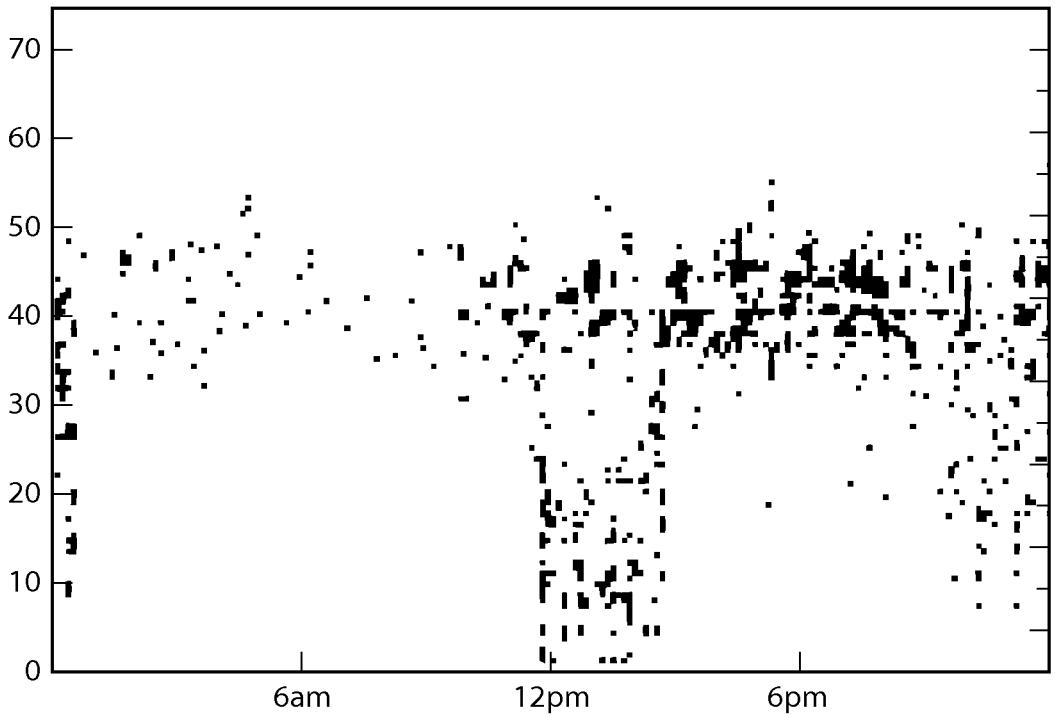
FIG. 2 is a diagram illustrating probe data according to at least one example embodiment.

FIG. 2 is a diagram illustrating probe data according to at least one example embodiment. The example of FIG. 2 is merely an example and does not limit the scope of the claims. For example, the amount of probe data may vary, the type of probe data may vary, the distribution of probe data may vary, the format of the probe data may vary, the representation of the probe data may vary, and/or the like.

In recent times, real time data of vehicular traffic is increasingly collected. Such real time data may include information indicative of the speed of a vehicle, the location of a vehicle, the time the data was collected, and/or the like. For example, a particular data point within a set of real time data may indicate the speed of a vehicle at a particular location during a particular time period. Data points within a set of real time data may be referred to as probe data. Such probe data may, for example, be collected to create speed-vs-time curves, historical traffic models, to perform real time traffic analysis, to create forward looking traffic predictions, and/or the like. Probe data may be collected from vehicle mounted sensors, GPS-enabled devices (e.g. smart phones), road sensors, traffic cameras, traffic reports, witnesses, and/or the like. Probe data may be centrally collected and distributed, broadcast, and/or the like to various receivers, subscribers, and/or the like (e.g. via a wireless network), such as to mobile navigation systems, portable navigation systems, news organizations, electronic road signs, and/or the like. Alternatively, or in addition thereto, probe data may be collected by a mobile navigation system, a portable navigation system, a traffic reporting system, and/or the like for its own use. For example, a GPS system installed in a vehicle may record the position and speed of the vehicle at particular intervals (e.g. once every second) for its own use, road sensors may record the speed and time of vehicles as they pass a particular position, and transmit the data over a cellular data connection for reporting to subscription service, and/or the like. It will be appreciated that probe data collected by vehicle mounted sensors, road sensors, GPS-enable devices, and/or the like may be distributed via wireless peer to peer or mesh based networks, e.g. the data is passed from a source and then from vehicle to vehicle, each navigation system within a vehicle being both a consumer of the data and a repeater thereof. For example, probe data collected from vehicle mounted sensors may be shared between vehicles by way of a vehicular ad hoc network, similar as described in the Institute of Electrical and Electronics Engineers (IEEE) 802.11 and 802.16 standards.

Probe data may be organized for easier interpretation, comparison, and/or the like of individual data points within the probe data. For example, if probe data comprises vehicle speeds at particular times, the probe data may be organized as a speed-vs-time distribution. The example of FIG. 2 illustrates a scatter plot of a speed-vs-time distribution of probe data. In the example of FIG. 2, each individual point represents a particular speed of a vehicle at a particular time over a 24-hour period. In this manner, a particular point on the scatter plot may be interpreted as traveling at particular speed at corresponding time. For instance, a data point aligning with "12 pm" on the horizontal axis and "50" on the vertical axis may indicate that a vehicle was traveling at 50 miles per hour at 12 p.m. Even though the example of FIG. 2 illustrates a probe data collected over a particular time period, probe data may be collected over any time period. Even though the example of FIG. 2 illustrates probe data comprising speed and time, probe data may comprise other information, such as vehicle location, vehicle type, travel direction, and/or the like.

Figure 3:
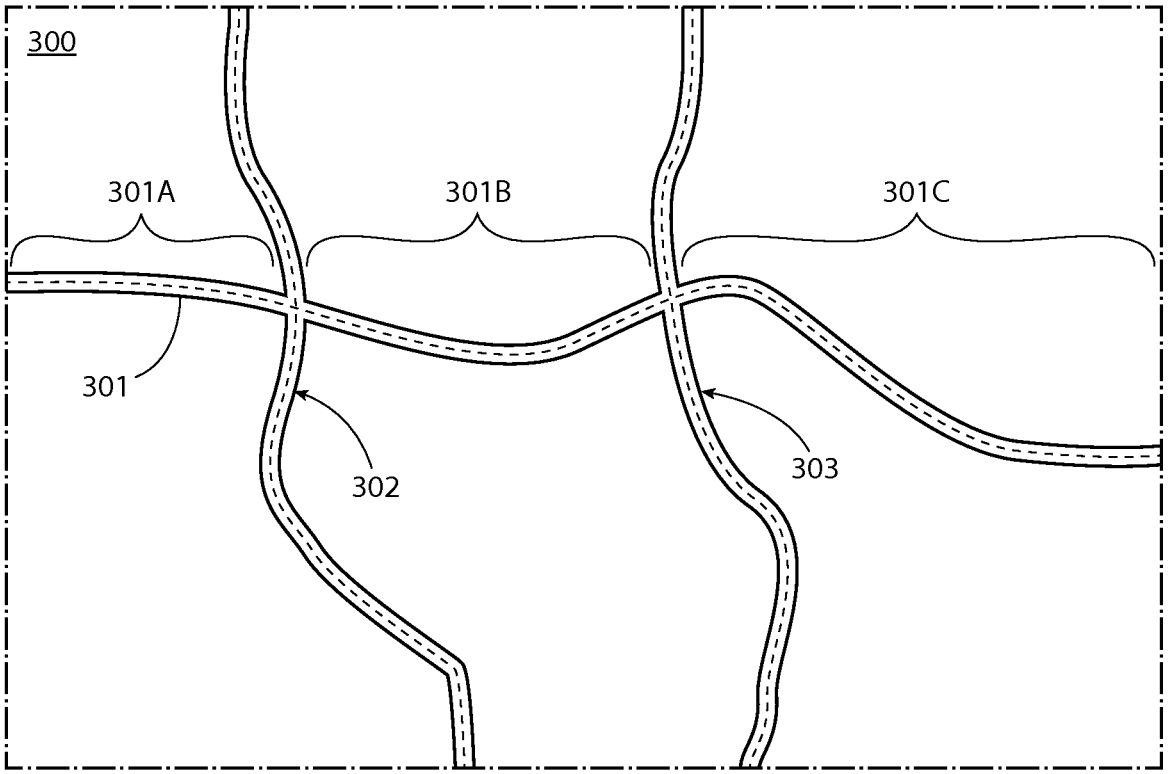
FIG. 3 is a diagram illustrating link segments according to at least one example embodiment.

FIG. 3 is a diagram illustrating link segments according to at least one example embodiment. The example of FIG. 3 is merely an example and does not limit the scope of the claims. For example, the number of link segments may vary, the type of link segments may vary, the direction of link segments may vary, the arrangement of link segments may vary, and/or the like.

Oftentimes, portions of a road, a highway, a street, and/or the like may be distinct. For example, a highway may be marked with distance markers, a street may be divided by intersections, and/or the like. A portion of a route, a lane, a road, a highway, a street, a trail, a thoroughfare, and/or the like may be referred to as a link segment. For example, a link segment may be a portion of a road between two intersections, a route between two cities, a portion of a street over a predefined distance (e.g. a mile, a kilometer, and/or the like), and/or the like. In at least one example embodiment, a link segment comprises at least a portion of a route, a lane, a road, a highway, a street, a trail, or a thoroughfare.

The example of FIG. 3 illustrates representation 300 of a portion of a map comprising roads 301, 302, and 303. Roads 301, 302 and 303 may each comprise one or more link segments. It can be seen in the example of FIG. 3 that road 301 is intersected by roads 302 and 303. In this manner, road 301 may be subdivided into link segments 301A, 301B, and 301C. Even though the example of FIG. 3 illustrates particular link segments of a road being defined by intersections along that road, it should be understood that any portion of a route, a lane, a road, a highway, a street, a trail, a thoroughfare, and/or the like may be a link segment.

When probe data is received (e.g. from a service provider, from a sensor, and/or the like), the probe data may not be associated with a particular link segment. In circumstances where received probe data is not associated with a link segment, it may be desirable to match probe data to link segments on a map. For instances, the probe data may not identify a reference to a particular link segment, but utilization of the probe data for analysis, traffic reporting, and/or the like may be facilitated by associating the probe data with a particular link segment. For example, creation of a historical traffic model may require probe data to be associated with a particular link segment. A historical traffic model may refer to a model of traffic behavior over time based, at least in part, on historical traffic data. For example, a historical traffic model may model the speed of a particular link segment at various times of the day based, at least in part, on data collected at similar times of day over an extended period of time. Probe data may be matched to a link segment on a map using a number of known methods. For example, a computer program may be utilized that associates location information comprised by particular probe data with particular link segments. For instance, probe data may include a position received from a GPS receiver, and the GPS coordinates may be utilized by the computer program to determine a corresponding link segment. In another example, probe data may be manually associated with link segments, though a manual approach may be labor intensive, insufficiently fast, and/or the like.

Figure 4A:
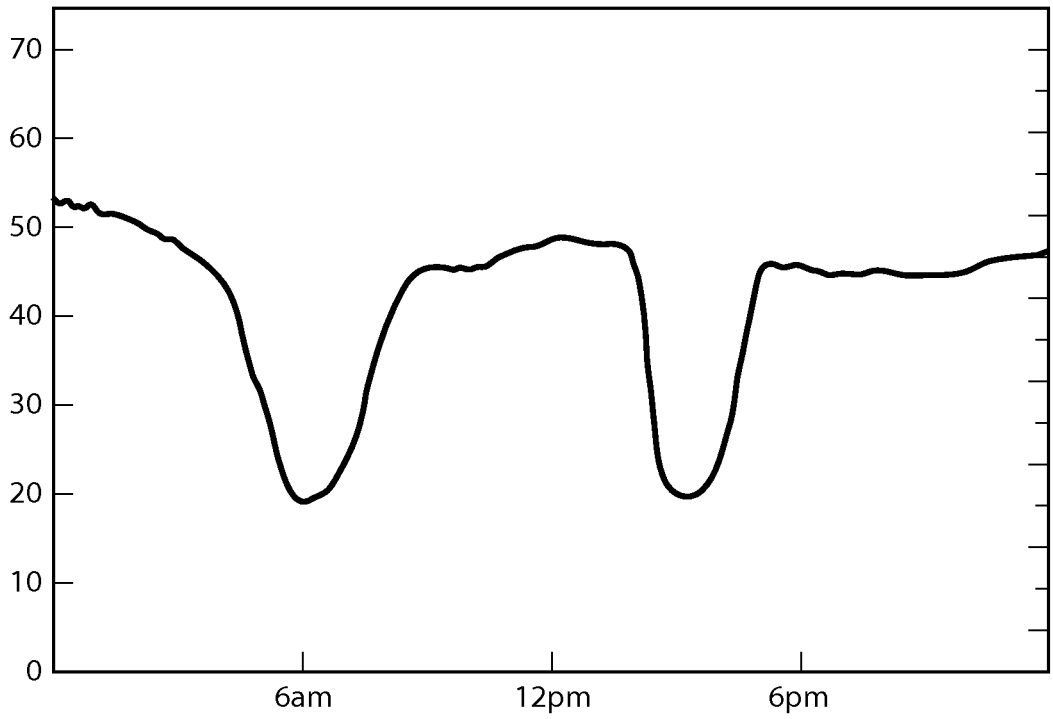
FIGS. 4A-4B are diagrams illustrating creation of link segment profiles according to at least one example embodiment.
Figure 4B:
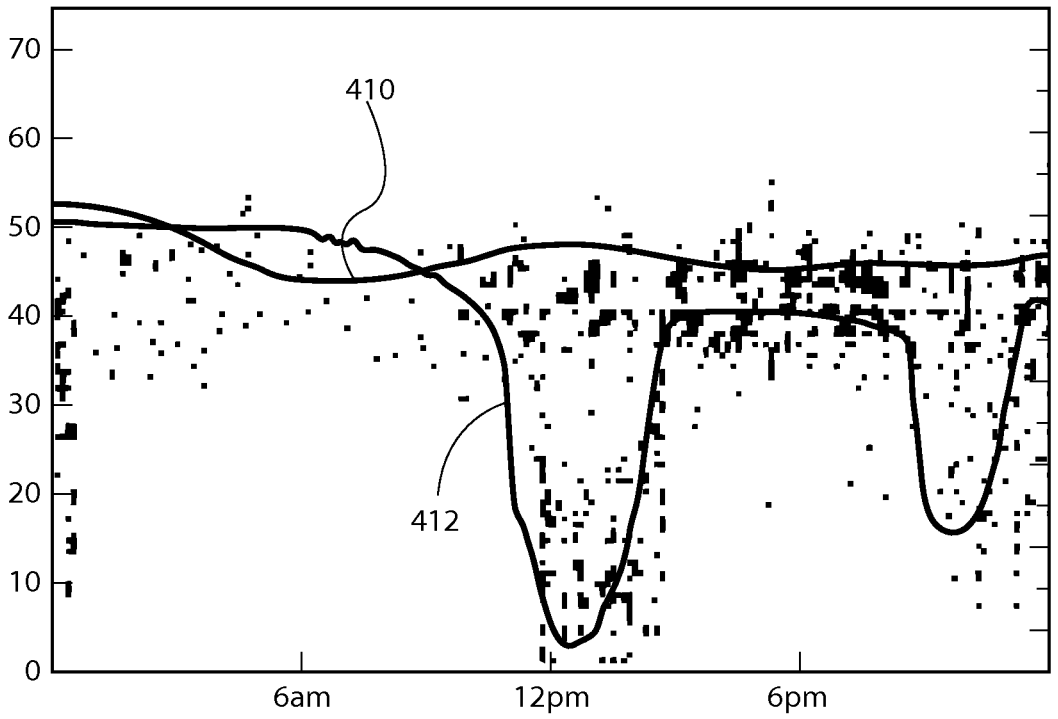

FIGS. 4A-4B are diagrams illustrating creation of link segment profiles according to at least one example embodiment. The examples of FIGS. 4A-4B are merely examples and do not limit the scope of the claims. For example, the type of link segment profile may vary, the representation of the link segment profile may vary, the time period may vary, the link segment may vary, and/or the like.

As previously described, real time data of vehicular traffic may be collected to create historical traffic models. For example, a historical traffic model may be produced by way of performing at least one of matching probe data to link segments on a map, creating link segment profiles for individual link segments, clustering similar link segment profiles, associating clusters from neighboring links, and/or the like. Clustering may refer to grouping a set of objects such that objects in the same group (which may be referred to as a cluster) are more similar in at least one aspect to each other than to those in other groups (clusters).

A link segment profile may refer to a speed-vs-time curve associated with a particular link segment. For example, a speed-vs-time distribution, such as the scatter plot of FIG. 2, may be associated with a particular link segment. In in such an example, a link segment profile may be created by performing a known curve fitting procedure (e.g. interpolation, smoothing, and/or the like) on the speed-vs-time distribution to create a speed-vs-time curve associated with the link segment. A link segment profile associated with a particular link segment over a particular period (e.g. 24-hours) may be represented similar as shown regarding FIG. 4A.

The example of FIG. 4A illustrates a graphical representation of a speed-vs-time curve for traffic on a particular link segment over a 24-hour period. In this manner, the speed-vs-time curve of FIG. 4A may be a link segment profile for the associated link segment. Such a link segment profile may indicate an average, expected, anticipated, and/or the like at a particular time for a link segment. For example, It can be seen in the example of FIG. 4A that a link segment associated with the link segment profile experienced higher traffic speeds at 12 pm than at 6 am and 6 pm. In this manner, the link segment profile of FIG. 4A may indicate that 6 am and 6 pm are periods of heavier traffic, commute times may be shorter on the link segment associated with the link segment profile of FIG. 4A at 12 pm, and/or the like. Even though FIG. 4A illustrates a speed-vs-time curve for a particular link segment, it should be understood that a link segment may have multiple link segment profiles, a link segment profile may apply to more than one link segment, and/or the like.

In some circumstances a profile may not exist for a particular link segment, an existing profile may comprise stale data, and/or the like. In circumstances such as these, it may be desirable to create a profile for a link segment from probe data. Probe data matched to a location may be intermittent (e.g. some time periods may have no probe data), noisy (e.g. have unexplainable probe data variation), and may sometimes bifurcate into multiple subpopulations. For example, in some circumstances, multiple link segments may run in parallel. For instance, a highway may comprise multiple lanes running in a parallel direction, as well as a neighboring feeder road. In circumstances such as these, portions of each individual lane and the feeder road may comprise individual link segments. When using probe data, it may be difficult to associate individual probe data points with a particular link segment. For instance, the precision of position data within an individual probe data point may be such that the individual probe data point could be associated with multiple link segments. Clustering (e.g. for creation of a historical traffic model) may require individual speed-vs-time curves and/or link segment profiles for each link segment, speed-vs-time curves, and/or link segment profiles without temporal gaps, and/or the like. In circumstances such as these, it may be desirable to perform a curve fitting procedure on a speed-vs-time distribution of probe data that identifies a number of simultaneous curves in the speed-vs-time distribution. In this manner, each identified curve may be a distinct link segment profile. For example, such a curve fitting procedure may be performed on the speed-vs-time distribution of FIG. 2 producing multiple link segment profiles from the distribution. For example, the speed-vs-time distribution of FIG. 2 may illustrate a distribution of a single stream of probe data (e.g. data collected from all the lanes of a multi-lane highway simultaneously), and the curve fitting procedure may identify a link segment profile for each lane.

The example of FIG. 4B illustrates a graphical representation of curve fitting procedure similar as described applied to the distribution of FIG. 2. In the example of FIG. 4B, the result of the curve fitting procedure has produced a first curve 410 and a second curve 412. In this manner, curve 410 may be a link segment profile for a link segment, and curve 412 may be a different link segment profile for a different link segment. In this manner, a particular point on one of curves 410 and/or 412 may be interpreted as an average speed a vehicle may travel at corresponding time on a corresponding link segment. For instance, a data point aligning with "12 pm" on the horizontal axis and "50" on the vertical axis on curve 410 may indicate that a vehicle may expect at 50 miles per hour at 12 p.m. on a link segment associated with curve 410.

Figure 5:
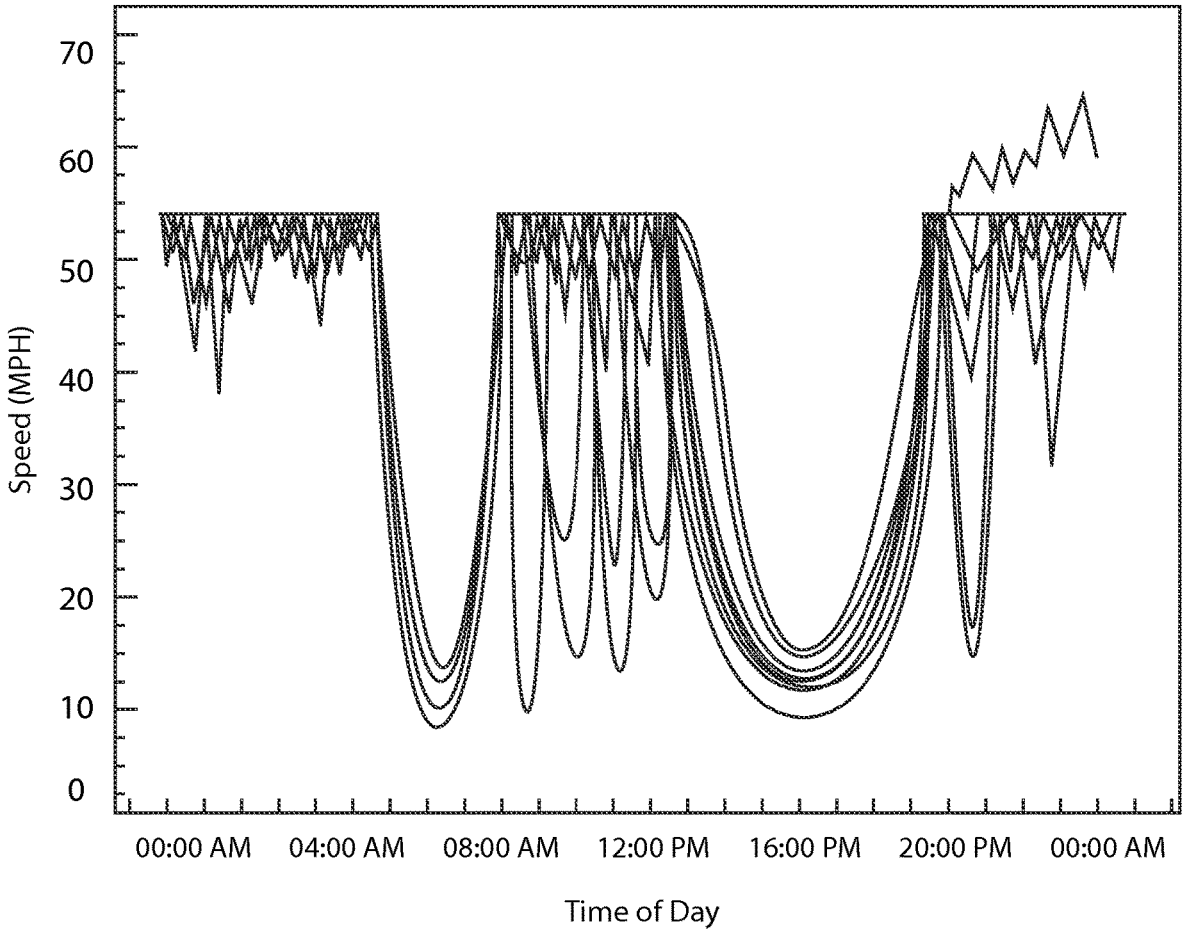
FIG. 5 is a diagram illustrating clustering of link segment profiles according to at least one example embodiment.

FIG. 5 is a diagram illustrating clustering of link segment profiles according to at least one example embodiment. The example of FIG. 5 is merely an example and does not limit the scope of the claims. For the number of link segment profiles example, the type of link segment profiles may vary, the period of the link segment profiles may vary, and/or the like.

As previously described, a historical traffic model may be created by clustering similar link segment profiles for each link identified. As previously described, clustering may refer to grouping a set of objects such that objects in the same group (which may be referred to as a cluster) are more similar in at least one aspect to each other than to those in other groups (clusters). For example, k-means clustering techniques may be used to find clusters of similar link segment profiles. The clusters resulting from clustering similar link segment profiles may be referred to as a speed-time clusters. In at least one example embodiment, k-means clustering techniques are performed to cluster similar link segment profiles. In such an example embodiment, k-means clustering may refer to a vector quantization in which n observations are partitioned into k clusters in which each observation belongs to the cluster with the nearest mean (expected value).

In typical k-means clustering scenarios, given a set of observations $(x_1, x_2, \ldots, x_n)$, where each observations is a d-dimensional real vector, a typical k-means clustering algorithm attempts to partition the n observations in $k(\leq n)$ sets $S=\{S_1, S_2, \ldots, S_k\}$ such that the within-cluster sum of squares (WCSS) is minimized. A well-known k-means clustering technique commonly referred to interchangeably as the "k-means algorithm" and "Lloyd's algorithm" utilizes an initialization procedure followed by an iterative process that varies between an assignment procedure and an update procedure.

As previously described, the "k-means algorithm" utilizes an initialization procedure. The initialization procedure may, for example, produce an initial set of k means $m_1^{(1)}, \ldots, m_k^{(1)}$. Commonly utilized initialization procedures for the "k-means algorithm" are "Forgy" and "Random Partition." The "Forgy" method randomly chooses k observations from the data set for use as the initial means. The "Random Partition" method randomly assigns a cluster to each observations, and then proceeds to the update step, computing the initial mean as the centroid of the cluster's randomly assigned point.

As previously described, the "k-means algorithm" utilizes an assignment procedure. During the assignment procedure, each observation may, for example, be assigned to the cluster whose mean yields the least within-cluster sum of squares (WCSS). As previously described, the "k-means algorithm" utilizes an update procedure. During the update procedure, new means (expected values) are calculated as the centroids of the observations in the new clusters. The "k-means algorithm" continues to alternate between the assignment procedure and the update procedure until the assignments no longer change.

The example of FIG. 5 illustrates a graphical representation of a speed-time cluster comprising of a plurality of individual link segment profiles associated with the same link segment. It can be seen that the example of FIG. 5 depicts a plurality of link segment profiles associated with the same link segment superimposed onto each other. Each link segment profile of the speed-time cluster of FIG. 5 has an identical period of 24 hours. Even though the speed-time cluster of FIG. 5 illustrates a particular period (i.e. 24 hours), it should be understood that a speed-time cluster may comprise link segment profiles for any period of time (e.g. 6 hours, 12 hours, 48 hours, etc.). It can be seen that each link segment profile of the speed-time of cluster of FIG. 5 has a similar curve shape. In this manner, the speed-time cluster of FIG. 5 may have been generated by a clustering technique, such as k-means clustering.

Speed-time clusters may be useful for example, to predict real-time traffic for link segments. For instance, a prediction algorithm may compare a speed-time cluster to real-time probe data to determine a speed-vs-time curve that best fits the probe data. The determined speed-vs-time curve may be used to predict the traffic speed for a user on that segment at a particular time. For example, predicted traffic speeds may be useful for users, for example, to estimate travel times more accurately for short term future trips. For instance the predicted traffic speeds may help users make decisions such as when to start a trip to airport for a flight departing in the next couple of hours. The predicted traffic speeds may also be utilized by navigation systems, governmental or regulatory agencies, news organizations, other service providers, and/or the like to present users with accurate representations of expected road conditions, to compute accurate predicted travel times to a destination, and/or the like via various mediums such as a navigation system display, television, radio, SMS, electronic road signs, and/or the like.

In at least one example embodiment, a traffic speed for a link segment is predicted by matching real time probe data to with the link segment (for example, real time probe data collected over a period of 12 hours), interpolating a speed-vs-time curve from the real time probe data, finding the closest clusters that match the interpolated speed-vs-time curve, and averaging the clusters. In such an embodiment, the clusters picked may be affected by the real time probe data. For example, during a weekday with normal traffic, clusters may be selected that demonstrate traffic patterns with congested periods (e.g. rush hour), while during a weekend, clusters may be selected with smoother traffic (e.g. no congestion). Such a traffic speed prediction method is more likely to predict faster traffic speeds during periods of non-congestion, and slower speeds during periods of congestion. A program, application, algorithm, and/or the like that utilizes speed-time clusters to predict, analyze, record, and/or the like traffic speeds may be referred to as a speed-time cluster application.

Figure 6A:
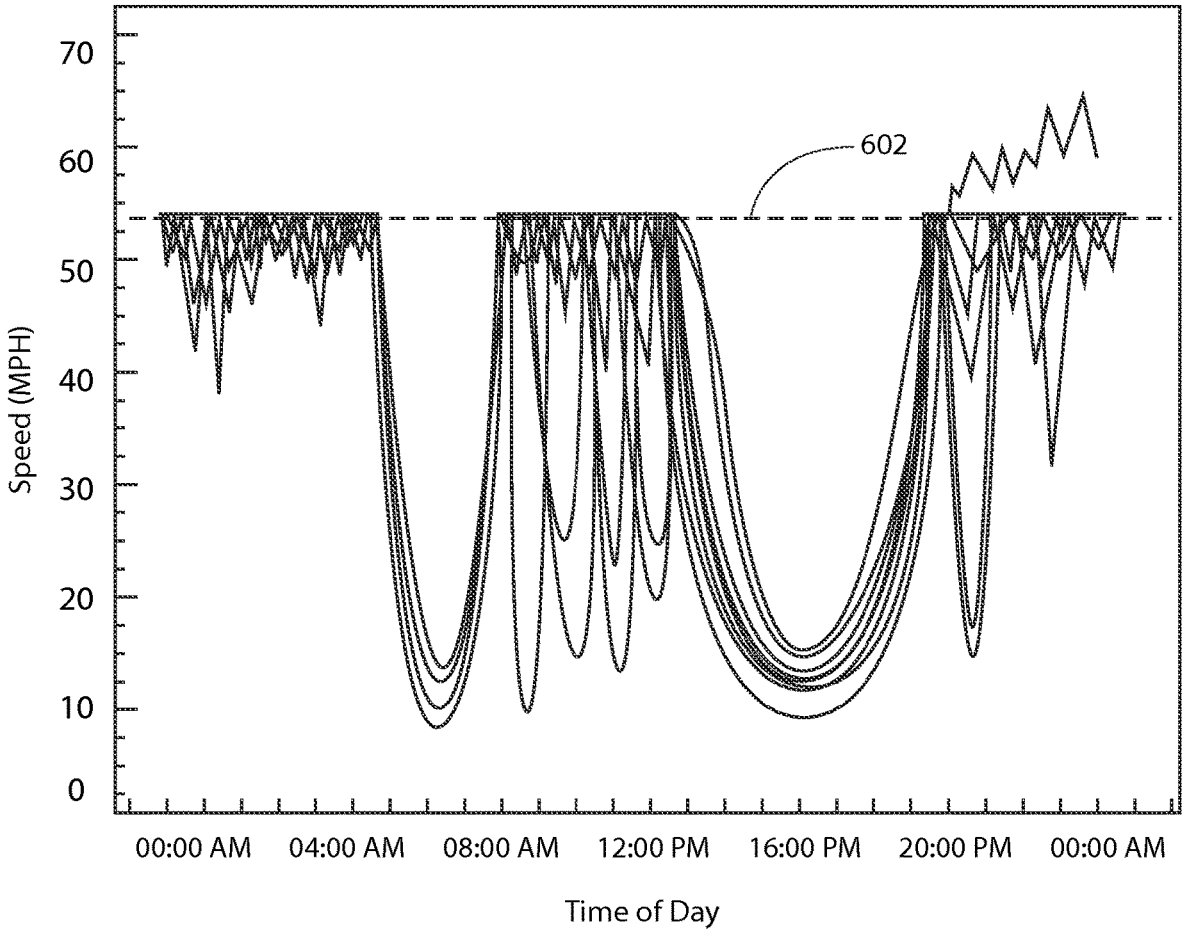
FIGS. 6A-6B are diagrams illustrating free-flow speed according to at least one example embodiment.
Figure 6B:
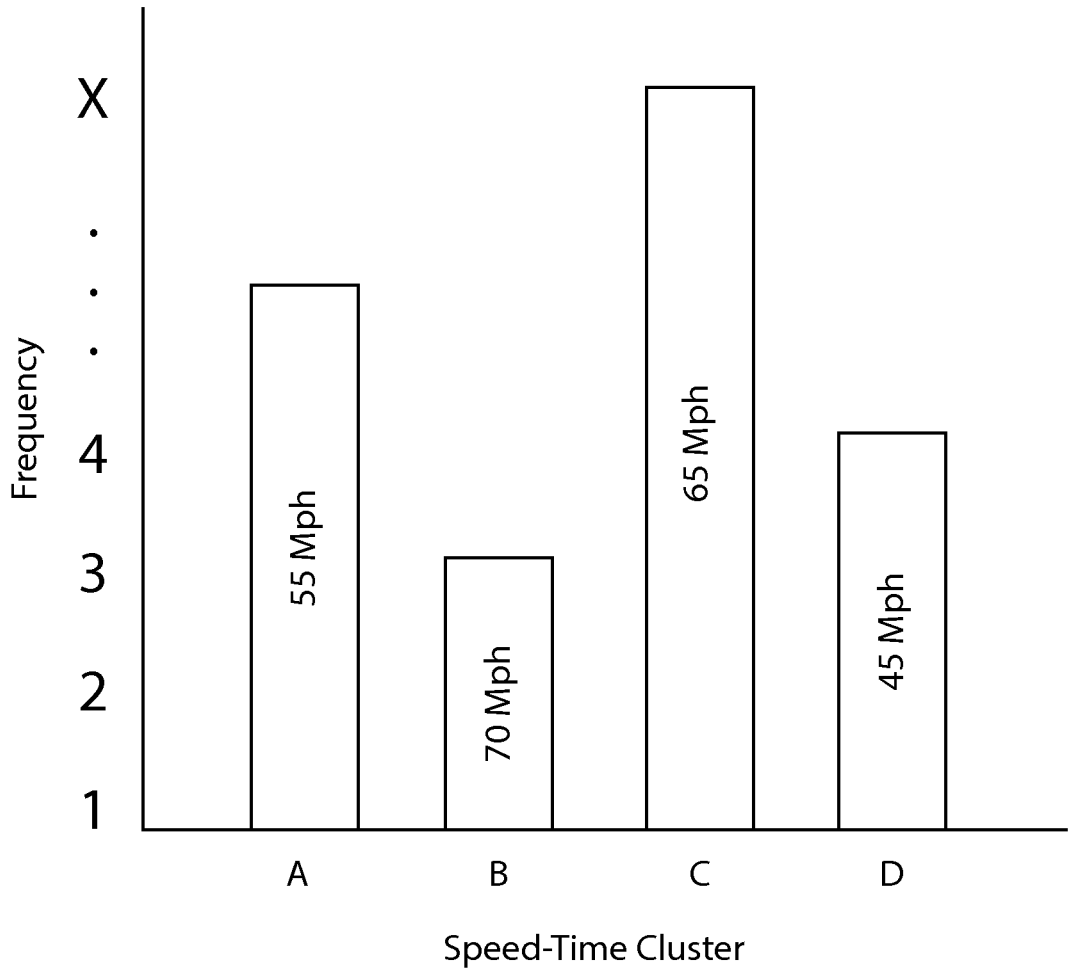

FIGS. 6A-6B are diagrams illustrating free-flow speed according to at least one example embodiment. The examples of FIGS. 6A-6B are merely examples and do not limit the scope of the claims. For example, the free-flow speed may vary, the link segment may vary, the speed-time cluster may vary, and/or the like.

In some circumstances, traffic on a link segment may rarely surpass a particular speed at a particular time. For example, traffic speed on a busy link segment during a congested period (e.g. rush hour) may rarely surpass a particular average speed (e.g. 35 miles per hour) at a particular time (e.g. 7:45 a.m.) irrespective of the posted speed limit of the road associated with the link segment. In another example, when traffic is non-congested (e.g. at 2:00 a.m.) the average traffic speed may be closer to (or even exceed) the speed limit of the link segment. For example, if the speed limit is 70 miles per hour, the free flow speed may be near 70 miles per hour, near 77 miles per hour, and/or the like. The average traffic speed of a link segment during a non-congested period may be referred to as the free-flow speed of the link segment.

In some circumstances, it may be desirable to determine the free-flow speed of a link segment. For instance, city planners, transportation departments of governments, and/or the like may utilize free-flow speeds of link segments for planning purposes. For example, a link segment with a free-flow speed that varies drastically from an assigned speed limit (e.g. a section of road with a 70 mile per hour speed limit and a free flow speed of 45 miles per hour) may be identified as requiring investigation for the discrepancy. For example, it may be discovered that a particular link segment of a road requires repairs, and the discrepancy between the speed limit and the free-flow speed was caused by traffic slowing down due to the state of the road. In an opposite example, where the free-flow speed is significantly higher than an assigned speed limit, law enforcement may be assigned to more heavily monitor the link segment for speeding violations, the speed limit may be raised to accommodate the higher free-flow speed, and/or the like.

Free flow speed data may also be useful for traffic prediction, mapping, and/or the like. For example, often map data providers utilize speed limit as a substitute for predicting the speed on a link segment when real-time traffic data is unavailable. In some circumstances, the speed limit of a link segment may be unknown, for example, due to a database of speed limits being incomplete. In circumstances such as these, a determined free-flow speed may be utilized as a proxy for speed limit data, the determined free-flow speed may be utilized as a transit speed for a link segment when making a traffic speed prediction, and/or the like.

In circumstances where a free-flow speed for one more link segments is unknown, it may be possible to determine a free-flow speed by way of a speed-time cluster. For example, a speed-time cluster for a particular link segment may be selected, and portions of the speed-time cluster that are indicative of non-congestion may be identified. In this manner, a free-flow speed for the link segment may be determined based on a speed indicated by the identified portions of the speed-time cluster that are indicative of non-congestion. For example, determination of the free-flow speed may be based on a maximum speed indicated by the identified portions of the speed-time cluster that are indicative of non-congestion, based on a percentage of a maximum speed indicated by the identified portions of the speed-time cluster that are indicative of non-congestion, and/or the like. For example, a percentage of a maximum speed indicated by the identified portions of the speed-time cluster that are indicative of non-congestion may be 85%. In this manner, 85% of the maximum speed indicated by the identified portions of the speed-time cluster may be determined as the free-flow speed of the link segment. In another example, a range of speeds (e.g. 80% to 90%) that are percentage of a maximum speed indicated by the identified portions of the speed-time cluster may be averaged, and the average may be determined as the free-flow speed of the link segment. In at least one example embodiment, determination of the free-flow speed based on the speed indicated by the identified portions of the speed-time cluster omits portions of the speed-time cluster that are indicative of congestion.

In some circumstances, a link segment may be congested at all times. For example, a portion of a freeway in a large city (e.g. Los Angeles Calif.) may always be busy with traffic. In circumstances such as these, congestion may peak during periods where workers are commuting, and may be less congested at other hours (non-peak congestion). In such an example, an average peak speed during non-commute hours on the link segment may be interpreted as the free flow speed. For example, if the average commuter is traveling at 40 miles per hours during non-commute hours despite a 55 mile per hour speed limit, the free flow speed may be determined to be 40 miles per hour. In these circumstances, non-commute hours may be referred to as periods of non-congestion. In at least one example embodiment, portions of a speed-time cluster corresponding with an average peak speed during non-commute hours are indicative of non-congestion.

The example of FIG. 6A illustrates a graphical representation of a speed-time cluster comprising of a plurality of individual link segment profiles associated with the same link segment similar as described in FIG. 5. In the example of FIG. 6A, a speed threshold 602 (illustrated is a dashed line) is superimposed over the graphical representation of the speed-time cluster of FIG. 5A. In this manner, portions of the speed-time cluster above speed threshold 602 may be indicative of speeds during non-congestion of the link segment associated with the speed-time cluster of FIG. 6A. Such speeds may be referred to as non-congestion speeds. Even though the example of FIG. 6A illustrates particular portions of the speed-time cluster as being indicative of speeds during non-congestion of a link segment, any portion of a speed-time cluster may be indicative of speeds during non-congestion of a link segment. For example, the position of cutoff line 602 may vary, other factors may be utilized to determine non-congestion, and/or the like.

In some circumstances, a free-flow speed for one more link segments based on a single speed-time cluster may be inaccurate. For example, the free-flow speed for a link segment may vary over time, a particular speed-time cluster may have an atypically high or low free-flow speed, and/or the like. In circumstances such as these, a historically normalized free-flow speed for the link segment may provide a more accurate representation of the typical free-flow speed for a link segment over time.

In some circumstances, a historically normalized free-flow speed may be determined by analyzing, monitoring, and/or the like the usage of speed-time clusters by a speed-time cluster application. For example, a speed-time cluster application similar as described regarding FIG. 5 may utilize various clusters associated with a particular segment at different periods of time. A record, database, a data log, and/or the like may be kept which tracks what speed-time clusters are selected by a speed-time cluster application over a period of time. For example, a data log may be kept for every speed-time cluster chosen for a particular link by a speed-time cluster application over a period of 6 months. Such a record, database, and/or the like may be referred to as a speed-time cluster application histogram data set. In at least one example embodiment, a speed-time cluster application histogram data set for a link segment is determined.

Each element of a speed-time cluster application histogram data set may comprise a plurality of various data. For example, each element may comprise a speed-time cluster and an applicable duration (e.g. frequency) of the speed-time cluster throughout the histogram duration. Histogram duration may refer to the period of time for which the speed-time cluster application histogram data set is recorded. For example, a speed-time cluster application histogram data set may comprise data recorded over a 3 month period, a 6 month period, or any other period of time. In at least one example embodiment, a speed-time cluster application histogram data set for a link segment-comprises a plurality of speed-time cluster application histogram data elements. In at least one example embodiment, each speed-time cluster application histogram data element identifies a speed-time cluster and an applicable duration of the speed-time cluster for the link segment throughout a histogram duration.

The example of FIG. 6B illustrates a graphical representation of a speed-time cluster application histogram data set. The speed-time cluster application histogram data set of FIG. 6B comprises data indicative of the frequency a particular speed-time cluster associated with a link segment was chosen by a speed-time cluster application over a period of time. In the example of FIG. 6B, it can be seen that four speed-time clusters (clusters A, B, C, and D) were selected with varying frequency by the speed-time cluster application over the period of time represented by the speed-time cluster application histogram data set of FIG. 6B. Even though the example FIG. 6B illustrates a speed-time cluster application histogram data set having a particular number of speed-time clusters selected with particular frequencies, it should be understood that a speed-time cluster application histogram data set may comprise any number of clusters, frequency may be represented in a different format (e.g. total the total amount of time a cluster is selected rather than the number of times a cluster is selected), and/or the like. It can be seen that each of the four speed-time clusters in the example of FIG. 6B is associated with a particular free-flow speed. The free-flow speed associated with each speed-time cluster may have been previously determined, determined when the speed-time cluster application histogram data set was created, and/or the like.

As previously described, a speed-time cluster application histogram data set may be determined while a speed-time cluster application is in use. In at least one example embodiment, determination of a speed-time cluster application histogram data set comprises receiving probe data indicative of speed of travel along the link segment, identifying an applicable speed-time cluster associated with the link segment that is applicable to the probe data, determining an applicable duration throughout the histogram duration in which the applicable speed-time cluster is applicable to the probe data, and determining a speed-time cluster application histogram data element of the speed-time cluster application histogram data set that indicates the applicable speed-time cluster and the applicable duration.

To determine a historically normalized free-flow speed for a link segment from a speed-time cluster application histogram data set, the weighted average of each of the free-flow speed determined for each speed-time cluster application histogram data element weighted by the applicable duration of the speed-time cluster application histogram data element. For example, a histogram a speed-time cluster application histogram data set may indicate a speed time cluster "A" with a determined free-flow speed of "55 mph" has a frequency of "7", a speed time cluster "B" with a determined free-flow speed of "70 mph" has a frequency of "2", a speed time cluster "C" with a determined free-flow speed of "65 mph" has a frequency of "10", and a speed time cluster "D" with a determined free-flow speed of "45 mph" has a frequency of "3." In such an example, a historically normalized free-flow speed for the link segment may be calculated as $$\frac{(55\text{ mph}\times 7)+(70\text{ mph}\times 2)+(65\text{ mph}\times 10)+(45\text{ mph}\times 3)}{(7+2+10+3)}\approx 59.545\text{ mph}$$

where 59.545 mph is approximately the weighted average of the free-flow speed determined for each speed-time cluster application histogram data element weighted by the applicable duration of the speed-time cluster application histogram data element.

As previously described, in some circumstances a free-flow speed may be utilized as a transit speed for a link segment when making a traffic speed prediction. In similar circumstances, a historically normalized free-flow speed may be utilized as a transit speed for a link segment when making a traffic speed prediction. In at least one example embodiment, a transit speed of the link segment is identified as being the historically normalized free-flow speed for the link segment.

In some circumstances, a link segment may be geospatially associated with a set of link segments. For example, link segment 301B of FIG. 3 may be geospatially associated with link segments 301A and 301C of FIG. 3. In circumstances such as these, it may be desirable to determine a transit speed for the combined set of link segments. For example, a person planning a route along the set of link segments may desire to estimate the transit speed for a route that includes the set of link segments. In such an example, the free-flow speed of a single link segment comprised by the route may be used to estimate the transit speed along the route. In another example, geospatial association of different link segments comprised by a road may provide a better understanding of traffic patterns on the road. For example, the free flow speed of the geospatially associated link segments may be compared to identify bottlenecks, points of congestion, and/or the like. In at least one example embodiment, a link segment is determined to be geospatially associated with a set of link segments. In at least one example embodiment, a transit speed of the set of link segments is identified as being the historically normalized free-flow speed. In at least one example embodiment, identifying a transit speed of the link segment comprises utilization of the transit speed in an estimated time of arrival calculation, generation of a long term traffic flow report that characterizes the link segment, and/or the like.

Figure 7:
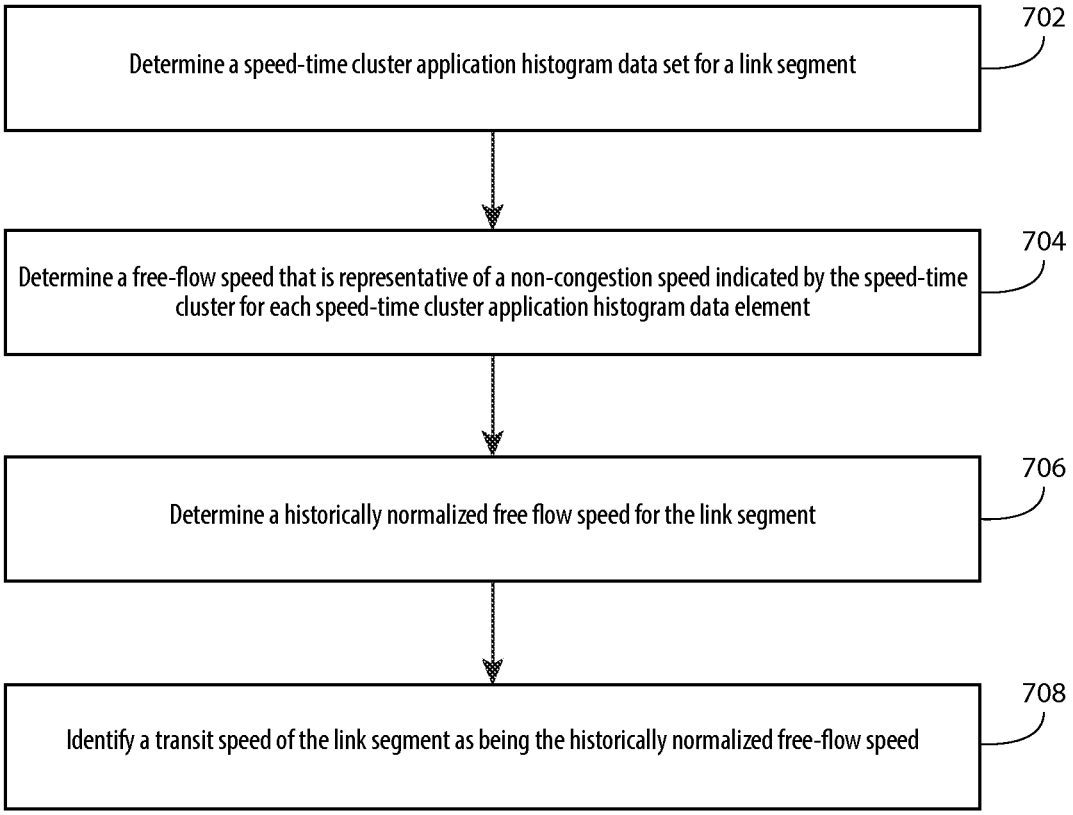
FIG. 7 is a flow diagram illustrating activities associated with determining a historically normalized free flow speed according to at least one example embodiment.

FIG. 7 is a flow diagram illustrating activities associated with determining a historically normalized free flow speed according to at least one example embodiment. In at least one example embodiment, there is a set of operations that corresponds with the activities of FIG. 7. An apparatus, for example electronic apparatus 10 of FIG. 1, or a portion thereof, may utilize the set of operations. The apparatus may comprise means, including, for example processor 11 of FIG. 1, for performance of such operations. In an example embodiment, an apparatus, for example electronic apparatus 10 of FIG. 1, is transformed by having memory, for example memory 12 of FIG. 1, comprising computer code configured to, working with a processor, for example processor 11 of FIG. 1, cause the apparatus to perform set of operations of FIG. 7.

As previously described, in some circumstances it may be desirable to historically normalized free flow speed for a link segment.

At block 702, the apparatus determines a speed-time cluster application histogram data set for a link segment. The speed-time cluster application histogram data set that may comprise a plurality of speed-time cluster application histogram data elements such that each speed-time cluster application histogram data element identifies a speed-time cluster and an applicable duration of the speed-time cluster for the link segment throughout a histogram duration. The determination, the speed-time cluster application histogram data set, the link segment, the speed-time cluster application histogram data elements, the speed time clusters, the applicable duration, and the histogram duration may be similar as described regarding FIG. 2, FIG. 3, FIGS. 4A-4B, FIG. 5, and FIGS. 6A-6B.

At block 704, for each speed-time cluster application histogram data element, the apparatus determines a free-flow speed that is representative of a non-congestion speed indicated by the speed-time cluster. The determination, the free-flow speed, and the non-congestion speed may be similar as described regarding FIG. 5 and FIGS. 6A-6B.

At block 706, the apparatus determines a historically normalized free-flow speed for the link segment. The determination and the historically normalized free-flow speed may be similar as described regarding FIGS. 6A-6B.

At block 708, the apparatus identifies a transit speed of the link segment as being the historically normalized free-flow speed. The identification and the transit speed may be similar as described regarding FIG. 2, FIG. 3, FIGS. 4A-4B, FIG. 5, and FIGS. 6A-6B.

Figure 8:
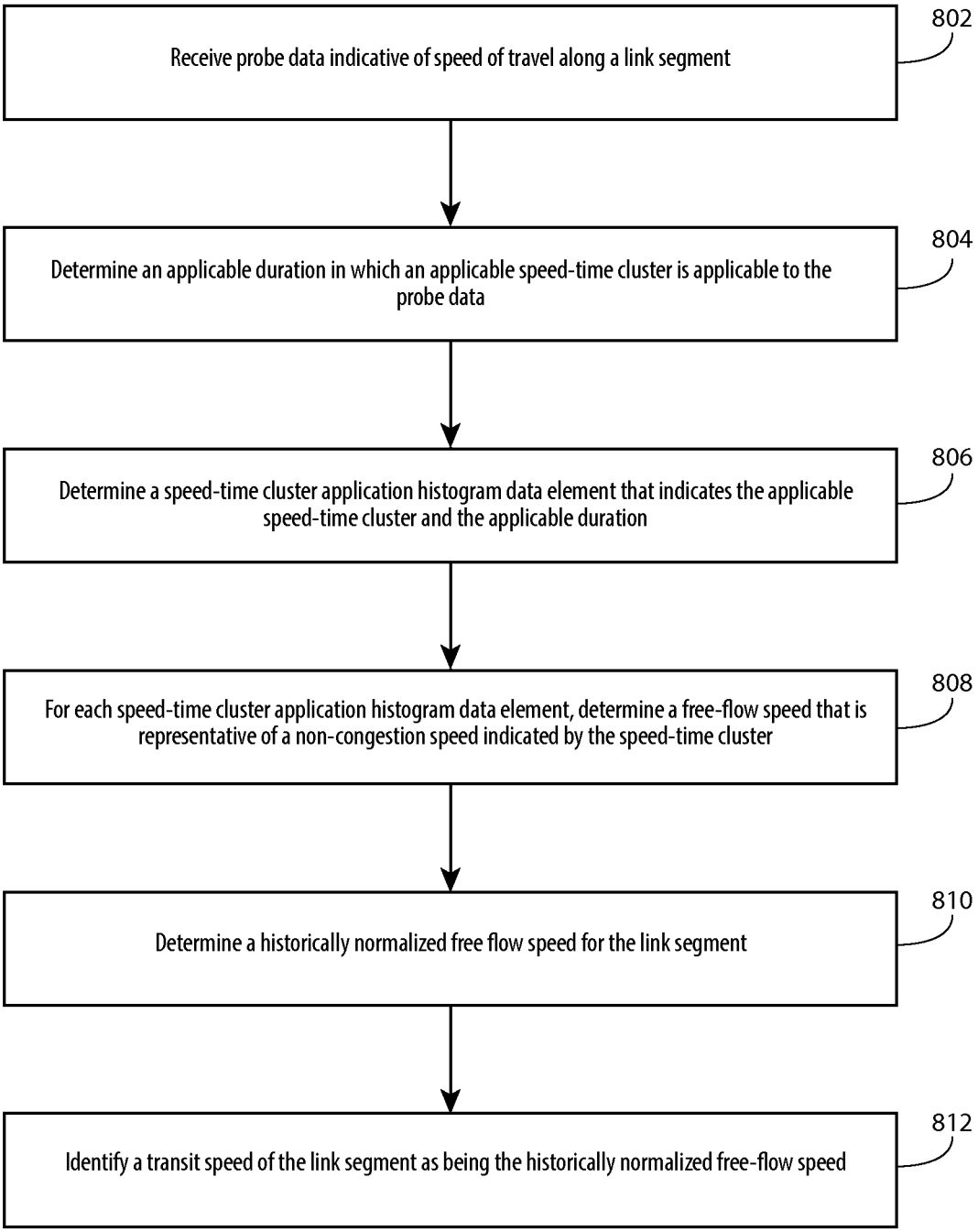
FIG. 8 is a flow diagram illustrating activities associated with determining speed-time cluster application histogram data set according to at least one example embodiment.

FIG. 8 is a flow diagram illustrating activities associated with determining speed-time cluster application histogram data set according to at least one example embodiment. In at least one example embodiment, there is a set of operations that corresponds with the activities of FIG. 8. An apparatus, for example electronic apparatus 10 of FIG. 1, or a portion thereof, may utilize the set of operations. The apparatus may comprise means, including, for example processor 11 of FIG. 1, for performance of such operations. In an example embodiment, an apparatus, for example electronic apparatus 10 of FIG. 1, is transformed by having memory, for example memory 12 of FIG. 1, comprising computer code configured to, working with a processor, for example processor 11 of FIG. 1, cause the apparatus to perform set of operations of FIG. 8.

As previously described, in some circumstances, it may be desirable to determine a speed-time cluster application histogram data set.

At block 802, the apparatus receives probe data indicative of speed of travel along the link segment. The receipt, the probe data, the speed of travel, and the link segment may be similar as described regarding FIG. 2, FIG. 3, FIGS. 4A-4B, FIG. 5, and FIGS. 6A-6B.

At block 804, the apparatus identifies an applicable speed-time cluster associated with the link segment that is applicable to the probe data. The identification and the speed-time cluster may be similar as described regarding FIG. 2, FIG. 3, FIGS. 4A-4B, FIG. 5, and FIGS. 6A-6B.

At block 806, the apparatus determines an applicable duration throughout the histogram duration in which the applicable speed-time cluster is applicable to the probe data. The applicable duration and the histogram duration may be similar as described regarding FIGS. 6A-6B.

At block 808, for each speed-time cluster application histogram data element, the apparatus determines a speed-time cluster application histogram data element of the speed-time cluster application histogram data set that indicates the applicable speed-time cluster and the applicable duration.

At block 810, the apparatus determines a historically normalized free-flow speed for the link segment similarly as described regarding block 706 of FIG. 7. At block 812, the apparatus identifies a transit speed of the link segment as being the historically normalized free-flow speed, similarly as described regarding block 708 of FIG. 7.

Figure 9:
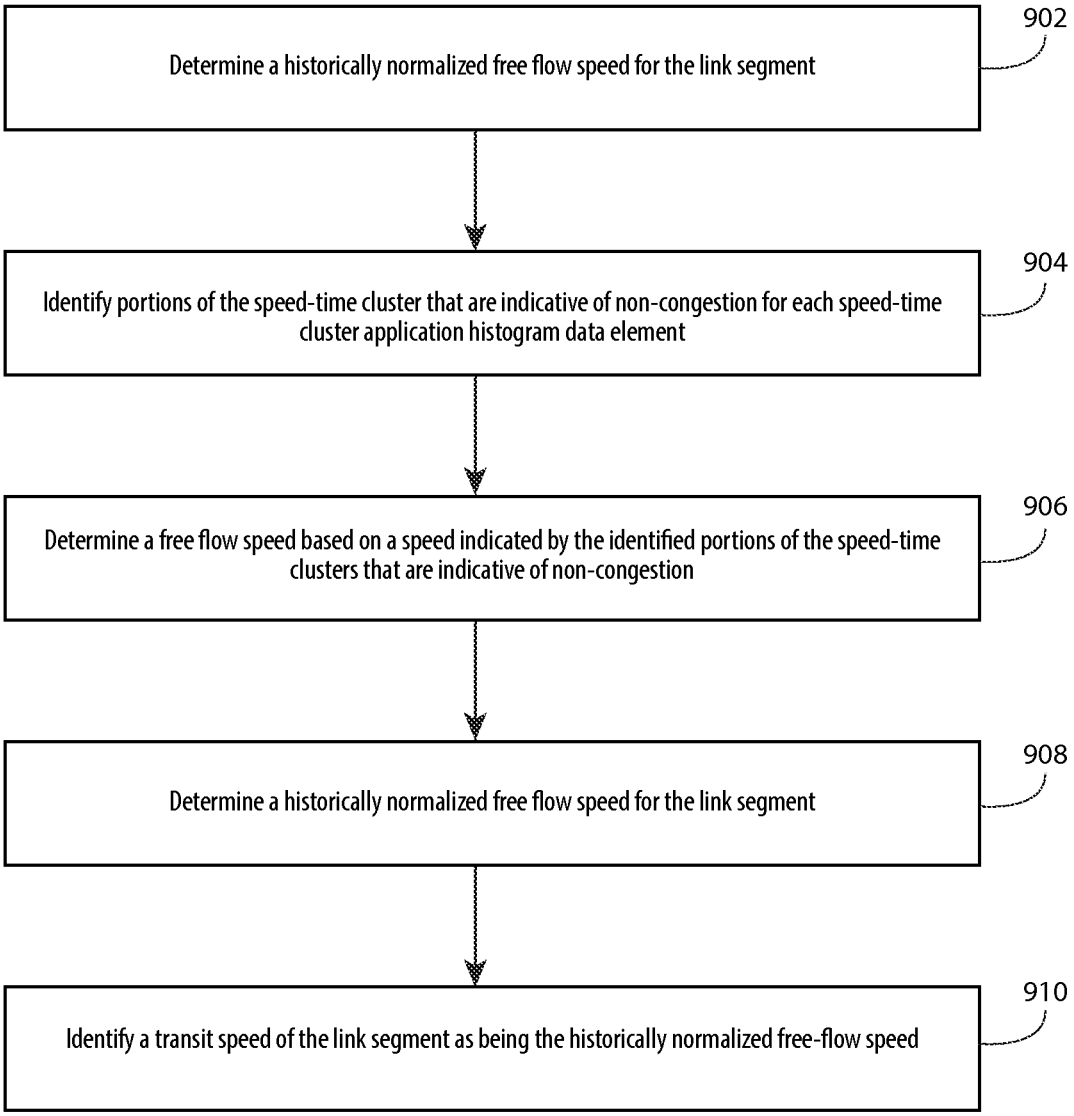
FIG. 9 is a flow diagram illustrating activities associated with determining a free-flow speed according to at least one example embodiment.

FIG. 9 is a flow diagram illustrating activities associated with determining a free-flow speed according to at least one example embodiment. In at least one example embodiment, there is a set of operations that corresponds with the activities of FIG. 9. An apparatus, for example electronic apparatus 10 of FIG. 1, or a portion thereof, may utilize the set of operations. The apparatus may comprise means, including, for example processor 11 of FIG. 1, for performance of such operations. In an example embodiment, an apparatus, for example electronic apparatus 10 of FIG. 1, is transformed by having memory, for example memory 12 of FIG. 1, comprising computer code configured to, working with a processor, for example processor 11 of FIG. 1, cause the apparatus to perform set of operations of FIG. 9.

As previously described, in some circumstances it may be desirable to determine a free-flow speed for a link segment.

At block 902, the apparatus determines a speed-time cluster application histogram data set for a link segment, similarly as described regarding block 702 of FIG. 7. At block 904, for each speed-time cluster, the apparatus identifies portions of the speed-time cluster that are indicative of non-congestion. The determination, the speed time clusters, and the non-congestion may be similar as described regarding FIG. 5 and FIGS. 6A-6B.

At block 906, for each speed-time cluster, the apparatus determines the free-flow speed based on a speed indicated by the identified portions of the speed-time cluster that are indicative of non-congestion. The determination and the free flow speed may be similar as described regarding FIG. 5 and FIGS. 6A-6B.

At block 910, the apparatus determines a historically normalized free-flow speed for the link segment similarly as described regarding block 706 of FIG. 7. At block 912, the apparatus identifies a transit speed of the link segment as being the historically normalized free-flow speed, similarly as described regarding block 708 of FIG. 7.

Figure 10:
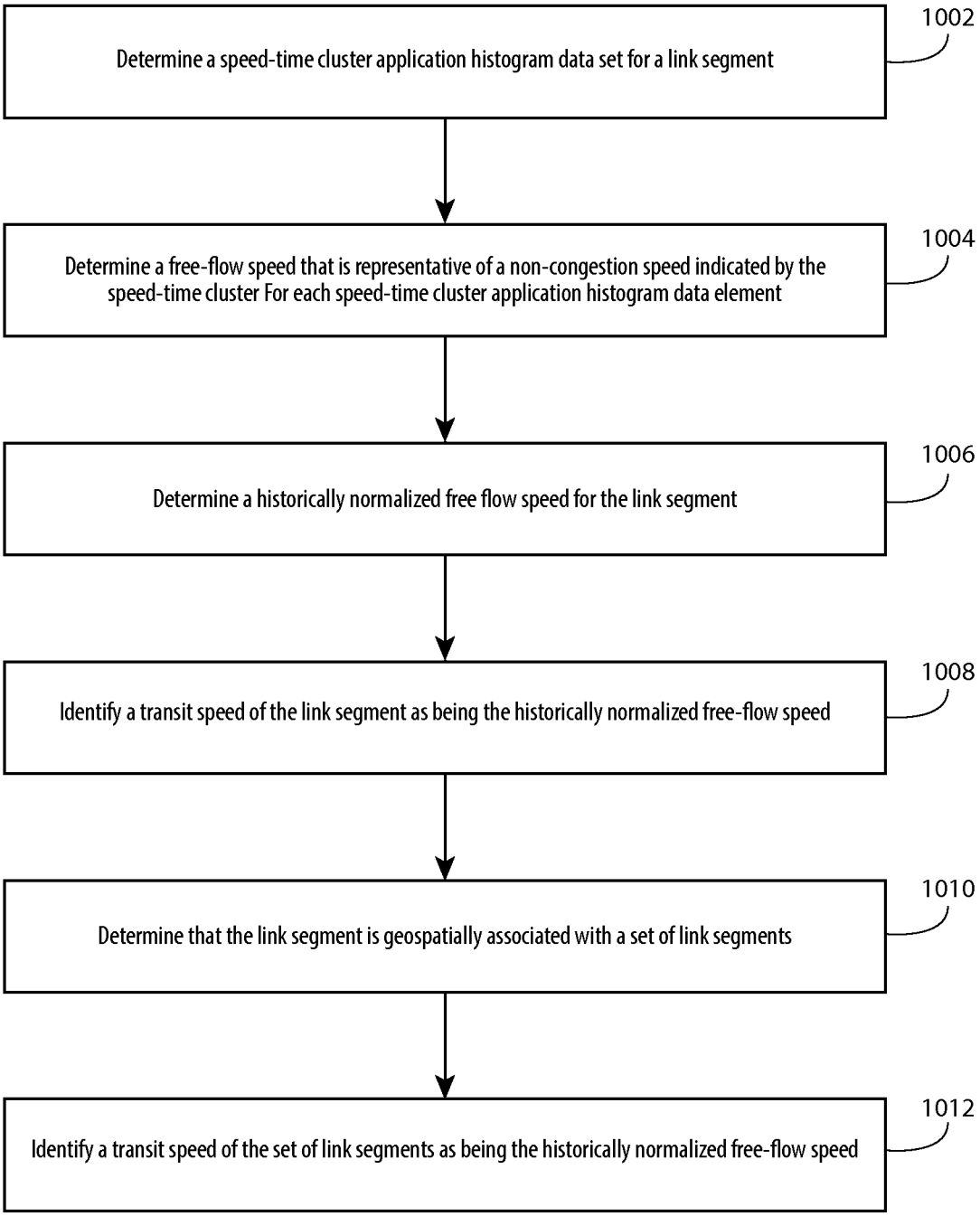
FIG. 10 is a flow diagram illustrating activities associated with identifying a transit speed of a set of link segments according to at least one example embodiment.

FIG. 10 is a flow diagram illustrating activities associated with identifying a transit speed of a set of link segments according to at least one example embodiment. In at least one example embodiment, there is a set of operations that corresponds with the activities of FIG. 10. An apparatus, for example electronic apparatus 10 of FIG. 1, or a portion thereof, may utilize the set of operations. The apparatus may comprise means, including, for example processor 11 of FIG. 1, for performance of such operations. In an example embodiment, an apparatus, for example electronic apparatus 10 of FIG. 1, is transformed by having memory, for example memory 12 of FIG. 1, comprising computer code configured to, working with a processor, for example processor 11 of FIG. 1, cause the apparatus to perform set of operations of FIG. 10.

As previously described, in some circumstances it may be desirable to determine a transit speed for a set of link segments.

At block 1002, the apparatus determines a speed-time cluster application histogram data set for a link segment, similarly as described regarding block 702 of FIG. 7. At block 1004, for each speed-time cluster application histogram data element, the apparatus determines a free-flow speed that is representative of a non-congestion speed indicated by the speed-time cluster, similarly as described regarding block 704 of FIG. 7. At block 1006, the apparatus determines a historically normalized free-flow speed for the link segment, similarly as described regarding block 706 of FIG. 7. At block 1008, the apparatus identifies a transit speed of the link segment as being the historically normalized free-flow speed, similarly as described regarding block 708 of FIG. 7.

At block 10, the apparatus determines that the link segment is geospatially associated with a set of link segments. The determination, the geospatial association, and the set of link segments may be similar as described regarding FIG. 3 and FIGS. 6A-6B.

At block 12, the apparatus identifies a transit speed of the set of link segments as being the historically normalized free-flow speed. The identification and the transit speed may be similar as described regarding FIG. 5 and FIGS. 6A-6B.

One or more example embodiments may be implemented in software, hardware, application logic or a combination of software, hardware, and application logic. The software, application logic, and/or hardware may reside on the apparatus, a separate device, or a plurality of separate devices. If desired, part of the software, application logic, and/or hardware may reside on the apparatus, part of the software, application logic and/or hardware may reside on a separate device, and part of the software, application logic, and/or hardware may reside on a plurality of separate devices. In an example embodiment, the application logic, software or an instruction set is maintained on any one of various computer-readable media.

If desired, the different functions discussed herein may be performed in a different order and/or concurrently with each other. For example, block 702 of FIG. 7 may be performed after block 704 of FIG. 7. Furthermore, if desired, one or more of the above-described functions may be optional or may be combined. For example, block 702 of FIG. 7 may be optional and/or combined with block 704 of FIG. 7.

Although various aspects of the present subject matter are set out in the independent claims, other aspects of the present subject matter comprise other combinations of features from the described example embodiments and/or the dependent claims with the features of the independent claims, and not solely the combinations explicitly set out in the claims.

It is also noted herein that while the above describes example embodiments, these descriptions should not be viewed in a limiting sense. Rather, there are variations and modifications which may be made without departing from the scope of the present subject matter.

What is claimed is:

1. A method comprising:

receiving probe data collected by one or more sensors;

calculating, by a processor, at least one non-congestion cluster from the probe data, the at least one non-congestion cluster based on speed and time for a link segment;

determining, by the processor, a free flow speed for the at least one non-congestion cluster;

calculating, by the processor, a historically normalized free flow speed for the link segment that is a weighted average of multiple speed clusters including the free flow speed of the at least one non-congestion cluster, the weighted average based on frequencies associated with the multiple speed clusters; and providing a predicted transit speed to a mapping system or a navigation system, the predicted transit speed based on the historically normalized free flow speed for the link segment.

2. The method of claim 1, further comprising:

map matching the probe data with the link segment.

3. The method of claim 1, wherein the at least one non-congestion cluster is based on a speed and time distribution.

4. The method of claim 3, further comprising:

fitting at least one speed and time curve to the speed and time distribution.

5. The method of claim 4, wherein the at least one speed and time curve includes a plurality of simultaneous curves for the speed and time distribution.

6. The method of claim 5, wherein each of the plurality of simultaneous curves represent a lane of a road.

7. The method of claim 1, further comprising:

recording a log of selection of link segments and speed clusters over time, wherein the historically normalized free flow speed is based, at least in part, on the log.

8. The method of claim 1, wherein each of the frequencies associated with the multiple speed clusters is a number of values for a particular one of the multiple speed clusters.

9. An apparatus comprising:

an input device configured to receive sensor data;

a processor configured to calculate at least one non-congestion cluster from the probe data, the at least one non-congestion cluster based on speed and time for a link segment and calculate a historically normalized free flow speed for the link segment that is a weighted average of multiple speed clusters including a free flow speed of the at least one non-congestion cluster, the weighted average based on frequencies associated with the multiple speed clusters; and an output device configured to provide a predicted transit speed for a mapping system or a navigation system, the predicted transit speed based on the historically normalized free flow speed for the link segment.

10. The apparatus of claim 9, wherein the processor is configured to perform map matching for matching the probe data with the link segment.

11. The apparatus of claim 9, wherein the weighted average of the at least one non-congestion cluster includes durations and frequencies of multiple speed clusters.

12. The apparatus of claim 9, wherein each of the frequencies associated with the multiple speed clusters is a number of values for a particular one of the multiple speed clusters.

13. An apparatus, comprising:

at least one processor;

at least one memory including computer program code, the memory and the computer program code configured to, working with the processor, cause the apparatus to perform at least the following:

receiving probe data collected by one or more sensors;

sending the probe data to a processor for calculating at least one non-congestion cluster from the probe data, the at least one non-congestion cluster based on speed and time for a link segment, and calculating a historically normalized free flow speed for the link segment that is a weighted average of multiple speed clusters including a free flow speed of the at least one non-congestion cluster, the weighted average based on frequencies associated with the multiple speed clusters; and providing a predicted transit speed to a mapping system or a navigation system, the predicted transit speed based on the historically normalized free flow speed for the link segment.

14. The apparatus of claim 13, further comprising:

a global positioning system included in the one or more sensors and configured to collect position data for a position of the apparatus.

15. The apparatus of claim 13, the memory and the computer program code configured to, working with the processor, cause the apparatus to perform:

map matching the probe data with the link segment.

16. The apparatus of claim 13, wherein the at least one non-congestion cluster is based on a speed and time distribution.

17. The apparatus of claim 16, the memory and the computer program code configured to, working with the processor, cause the apparatus to perform:

fitting at least one speed and time curve to the speed and time distribution.

18. The apparatus of claim 17, wherein the at least one speed and time curve includes a plurality of simultaneous curves for the speed and time distribution.

19. The apparatus of claim 18, wherein each of the plurality of simultaneous curves represent a lane of a road.

20. The apparatus of claim 13, the memory and the computer program code configured to, working with the processor, cause the apparatus to perform:

recording a log of selection of link segments and speed clusters over time, wherein the historically normalized free flow speed is based, at least in part, on the log.

* * * * *